US011174617B2

(12) United States Patent
Martinez et al.

(10) Patent No.: US 11,174,617 B2
(45) Date of Patent: Nov. 16, 2021

(54) SYSTEM AND METHOD FOR ALIGNING A CARRIER VEHICLE AND A SELECTIVELY ATTACHABLE IMPLEMENT

(71) Applicant: Deere & Company, Moline, IL (US)

(72) Inventors: Ignacio Alonso Martinez, Saltillo (MX); Claire Rogge, Mehlingen (DE)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 16/557,230

(22) Filed: Aug. 30, 2019

(65) Prior Publication Data

US 2019/0382980 A1 Dec. 19, 2019

Related U.S. Application Data

(63) Continuation of application No. 14/798,520, filed on Jul. 14, 2015, now Pat. No. 10,458,096.

(30) Foreign Application Priority Data

Sep. 11, 2014 (DE) ..... 102014218197.6

(51) Int. Cl.
*E02F 3/36* (2006.01)
*E02F 9/26* (2006.01)
(Continued)

(52) U.S. Cl.
CPC ..... *E02F 3/3604* (2013.01); *E02F 3/3631* (2013.01); *E02F 3/96* (2013.01); *E02F 9/26* (2013.01); *E02F 3/627* (2013.01)

(58) Field of Classification Search
CPC ..... B60D 1/36; B60D 1/363; E02F 3/3604; E02F 3/3627; E02F 3/3631; E02F 3/96; E02F 9/26; E02F 3/627; Y10S 37/906
(Continued)

(56) References Cited

U.S. PATENT DOCUMENTS 3,015,162 A 1/1962 Bonnet
3,710,968 A 1/1973 Clevenger et al.
(Continued)

FOREIGN PATENT DOCUMENTS

DE 1249305 B 9/1967
DE 2623098 A1 12/1977
(Continued)

OTHER PUBLICATIONS

European Search Report in foreign counterpart application No. 15181974.5 dated Mar. 10, 2016 (8 pages).

*Primary Examiner* — Saul Rodriguez
*Assistant Examiner* — Brendan P Tighe
(74) *Attorney, Agent, or Firm* — Michael Best & Friedrich LLP

(57) ABSTRACT

Carrier vehicles—such as, for example, front loaders—are configured to operated with one or more interchangeable implements that are selectively coupled to the carrier vehicle by driving the carrier vehicle towards a desired implement and aligning the implement attachment points with corresponding attachment points on an implement mount that is attached to the carrier vehicle. In some cases, the operator's view of the various attachment points (catch hook and support pins, rods, lines) of the implement and the implement mount is blocked by the front loader arms (booms) or other components of the carrier vehicle. Systems and methods are presented herein for aligning the carrier vehicle with the implement using marks/indicators that are visible by the operator of the carrier vehicle.

17 Claims, 3 Drawing Sheets

(51) Int. Cl.
*E02F 3/96* (2006.01)
*E02F 3/627* (2006.01)

(58) Field of Classification Search
USPC ..... 33/264, 288; 37/417; 414/685
See application file for complete search history.

(56) References Cited

U.S. PATENT DOCUMENTS

| | | | | | |
|---|---|---|---|---|---|
| 4,604,025 | A | | 8/1986 | Hammoud | |
| 4,856,200 | A | * | 8/1989 | Riggs | B60D 1/36 33/264 |
| D307,564 | S | * | 5/1990 | Mabry | D12/162 |
| 4,984,957 | A | * | 1/1991 | Noguchi | E02F 3/3631 172/273 |
| 5,309,289 | A | * | 5/1994 | Johnson | B60D 1/36 248/467 |
| 6,273,448 | B1 | * | 8/2001 | Cross | B60D 1/36 280/477 |
| 8,038,380 | B2 | | 10/2011 | Opperud | |
| 2005/0193603 | A1 | | 9/2005 | Schultz | |
| 2015/0233084 | A1 | * | 8/2015 | Seljestad | B66F 9/12 414/723 |
| 2016/0040387 | A1 | * | 2/2016 | Seljestad | E02F 3/3604 403/14 |

FOREIGN PATENT DOCUMENTS

| | | | |
|---|---|---|---|
| DE | 3924313 | A1 | 2/1990 |
| EP | 1586709 | A2 | 10/2005 |

* cited by examiner

SYSTEM AND METHOD FOR ALIGNING A CARRIER VEHICLE AND A SELECTIVELY ATTACHABLE IMPLEMENT

RELATED APPLICATIONS

This application is a continuation of U.S. patent application Ser. No. 14/798,520, filed on Jul. 14, 2015, entitled "A SYSTEM AND METHOD FOR ALIGNING A FRONT LOADER IMPLEMENT," which claims the benefit of German Patent Application No. 102014218197.6, filed, Sep. 11, 2014, the entire contents of both of which are incorporated herein by reference.

FIELD OF THE DISCLOSURE

The invention relates to a system and a method for alignment of a front loader implement.

BACKGROUND

Front loaders are known and are generally hitched to or detachably attached to a carrier vehicle, such as an agricultural tractor. Typically, front loaders have front loader arms (or booms) extending from and out in front of the carrier vehicle to an implement mount that allows for detachably connecting to an interchangeable implement, such as a loading shovel, a feed shovel, a loading fork, a bale gripper, or a spike. The implement is generally attached by catch hooks to support pins, rods or links that are formed on the implement mount. Alternatively, the catch hook may be on the implement mount and the support pin, rod or link on the implement.

In these processes, the implement and the implement mount must be brought into a predetermined position relative to one another in order to guarantee correct alignment and attachment. This is generally achieved in that an operator aims at the implement while driving towards it, attempting in particular to bring the catch hooks and the support pins, rod or links into alignment. This is made more difficult because the operator's view of the attachment points or essential components (catch hook and support pins, rods, links) of the implement and the implement mount is often blocked by the front loader arms (booms) or other front loader components, thus, aligning the implement and the implement can be very difficult and may have to be done "blindly". The above-mentioned processes when aligning an implement can take an extended period of time. This is annoying to the operator, unsatisfactory and not cost-effective, especially when implements are frequently exchanged.

Simplifying the above-described processes and in particular making them more user-friendly is therefore an important concern for an operator.

SUMMARY

In these processes, the implement and the implement mount must be brought into a predetermined position relative to one another in order to guarantee correct alignment and attachment. This is generally achieved in that an operator aims at the implement while driving towards it, attempting in particular to bring the catch hooks and the support pins, rods or links into alignment. This is made more difficult because the operator's view of the attachment points or essential components (catch hook and support pins, rods, links) of the implement and the implement mount is often blocked by the front loader arms (booms) or other front loader components, thus, aligning the implement and the implement can be very difficult and may have to be done "blindly".

According to an aspect of the present disclosure, a system and a method for alignment of an implement using marks that are visually recognizable from the cab of the carrier vehicle is disclosed. These marks on the implement and on the implement mount are in the region of the front loader operator's field of view during the alignment process and can be aligned with one another in the vertical direction and/or the horizontal direction.

Because the marks lie within the front loader operator's field of view during the alignment process of the implement, an operator can travel in a targeted manner to the required position, in which the catch hooks and the support pins are aligned correctly with one another. Thereby coupling maneuvering is minimized and the time expended for exchanging the implement is optimized and therefore the attachment process is made more cost-effective. For example, the implement can be provided with a mark in the form of a horizontal and vertically oriented cross or crosshairs, and the implement mount can be provided with a point-like mark. The marks are arranged offset toward the center of the implement in relation to the catch hooks and/or in relation to the carrier pins in such a way that they fall or lie within the visual field. When maneuvering and approaching with the front loader in order to attach an implement, the cross and the point-like marks are aligned with one another such that the point-like mark is preferably guided into the center of the cross. The operator then knows that the correct height and also the correct lateral position has been reached and that the catch hooks and support pins are aligned correctly in relation to one another, even if they are not within the visual field where they could be viewed by the operator. The operator can conclude the attachment process by simply lifting and tilting the implement carrier so that the locking devices engage with one another. The shapes of the marks on the front loader implement can be formed in a variety of ways; thus an arrow-shaped mark, linear marks aligned with one another, a circle, an "X" or the like can also be provided in place of a cross. The use of a circle is also advisable because the operator then need only guide the mark formed on the implement mount into the interior of the circle from his visual perspective.

The marks can also be formed in a variety of manners such as by distinctive colors or distinctive surface structures. It is additionally conceivable to use distinctive components formed on the front loader implement or on the implement carrier, such as a distinctive sheet-metal strip, a spike, a notch-and-bead sight, a pointer or the like.

It can also be advantageous to design the marks to be light-reflective, so that a faultless coupling is guaranteed even in poor weather, in the dark or at dusk, by illuminating the front area of the loader with lighting on the carrier vehicle.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

Figure 1:
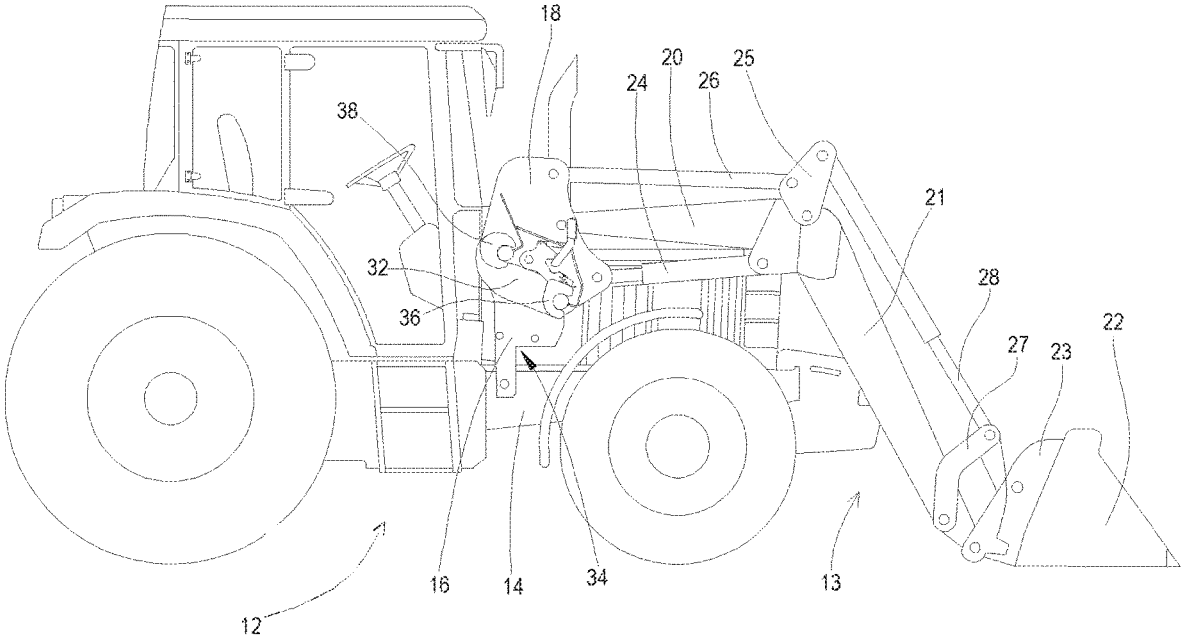
FIG. 1 is a schematic side view of a front loader arrangement having a front loader implement and an implement carrier.

Referring now to the drawings, and in particular FIG. 1, there is a front loader detachably coupled to a carrier vehicle 12 in accordance with an embodiment of the present disclosure. Carrier vehicle 12 may be an agricultural tractor. The front loader has two front loader arms (or booms) 20 extending from both sides of the carrier vehicle 12 to an implement mount 23 that allows for detachably connecting to an interchangeable implement 22. While the implement 22 shown in FIG. 1 is a loading shovel, one of ordinary skill in the art will realize that this implement 22 can be many different things including without limitation a feed shovel, a loading fork, a bale gripper, or a spike.

The front loader arms (or booms) 20 are coupled to a mounting mast 18, which, in turn, are detachably connected to a mounting frame 16 in receiving region 32. Further, the mounting frame 16 is attached to the vehicle frame 14 of the carrier vehicle 12 in the fastening region 34. The front loader arms 20 can be raised and lowered by hydraulic lifting cylinders 24. Between links 25, connected to the front loader arms 20 on each side, and the respective installation mast 18, there is a control rod 26 which is used for parallel guidance of the front loader.

Further, the implement mount 23, to which the implement 22 is be attached, is arranged at the front end of the front loader arms (or booms) 20. The implement 22 can be pivoted on both sides of the front loader arm 20 via a pivot rod 27 connected to the front loader arms 20 and the implement mount 23, and via a hydraulic pivot cylinder 28 connected to the respective pivot rod 27 and the respective link 25.

Figure 2:
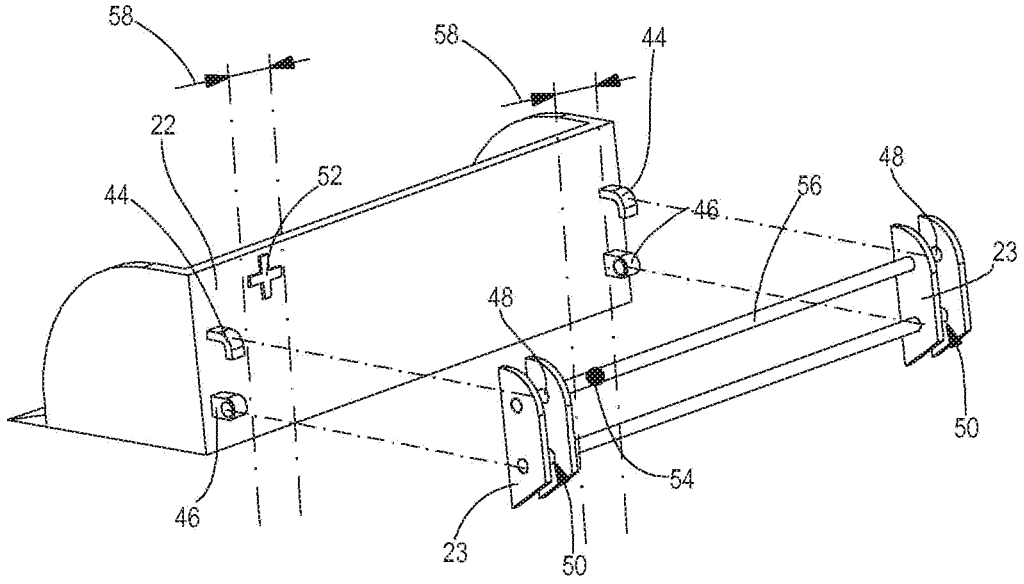
FIG. 2 is a perspective side view of the front loader implement and the front loader carrier from FIG. 1.

Now referring to FIG. 2, the rear side of the implement 22, catch hooks 44 arranged in the upper part are constructed and locking eyelets 46 are constructed in the lower part of the rear side. Support pins 48 and locking points 50 are formed on the implement mount 23. One of ordinary skill in the art will appreciate that there are numerous means for attaching the implement 22 to the implement mount 23 including without limitation having the catch hook on the implement mount and the support pin, rod or link on the implement.

Additionally, one of ordinary skill in the art will understand that the operator's view from the cab 40 of the implement 22 and the implement mount 23 may be blocked or crowded by the front loader components like the front loader arms 20, the installation mast 18, the link 25, or the engine hood 42.

As described in the present disclosure, use of marks 52, 54 that are visually recognizable from the cab 40 are utilized.

In one embodiment of the present disclosure, a mark 52 is applied to the implement 22 and a complementary mark 54 is applied to a frame part 56 of the implement mount 23. one of ordinary skill in the art will understand that these marks on the implement 22 and implement mount 23 can be formed in a variety of ways; including without limitation as a horizontal and vertically oriented cross or crosshairs, a point-like mark, an arrow-shaped mark, linear marks aligned with one another, a circle, and an "X". Further, one of ordinary skill in the art will understand that these marks can also be formed in a variety of manners such as by distinctive colors or distinctive surface structures; including without limitation distinctive sheet-metal strip, a spike, a notch-and-bead sight, or a pointer.

Figure 3:
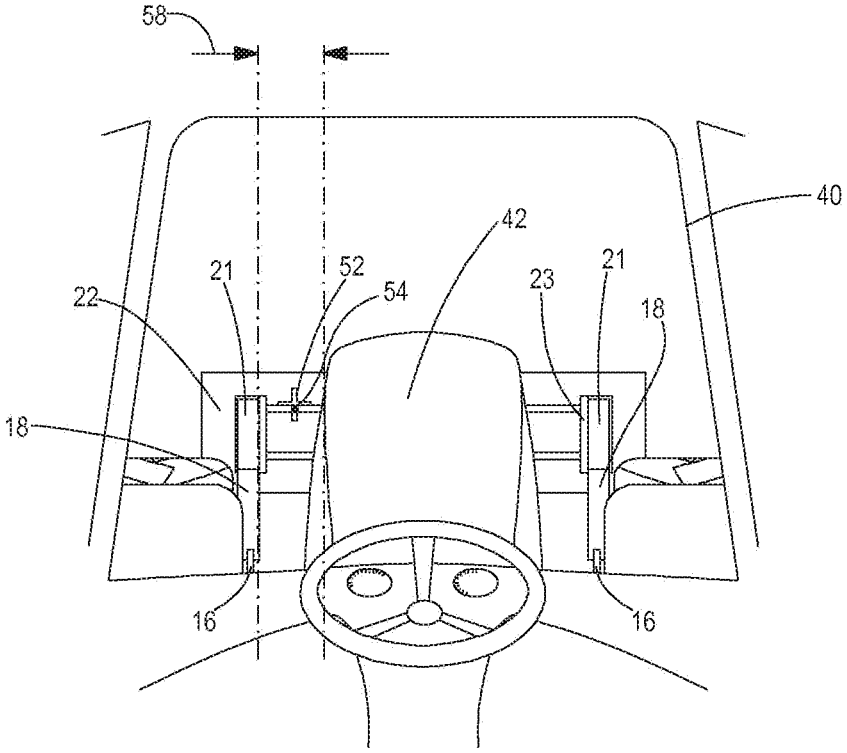
FIG. 3 is a schematic view of the front loader arrangement from the view of an operator during an attachment process.

In this embodiment of the present disclosure, with reference to FIG. 3, marks 52, 54 are situated in a region of a field of view 58, which extends on the side of the engine hood 42 and is bounded by the sides of the engine hood 42 and by the beams 21 extending forward from the mounting mast 18 to the implement carrier 23. The field of view 58 allows a free view of the implement carrier 23 and the front loader implement 22 in a region that lies between the catch hooks 44 and the support pins 48 and is not concealed by the front loader arm 20.

In this embodiment, FIG. 3 shows a view of the front loader from the perspective of an operator in the cab 40 during an attachment process of the implement 22. The engine hood 42 extends toward the front in the direction of travel of the carrier vehicle 12. The beams 21 of the front loader arms 20 are arranged on the sides of the engine hood 42 and extend parallel to the sides of the engine hood 42, likewise toward the front. The implement 22 and the implement mount 23 are located in front of the engine hood 42, wherein the catch hooks 44 and support pins 48 are concealed by the beams 21 and cannot be seen.

Alternatively, in this embodiment, mark 52 which is a horizontal and vertically oriented cross and mark 54 can be seen from the cab 40 and make easy and targeted maneuvering during the attachment process of the front loader implement 22 for the operator.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

What is claimed is:

1. A method comprising:

driving a carrier vehicle toward an implement, the carrier vehicle including a front loader with an implement mount, the implement mount including a first mark that is visually recognizable from the carrier vehicle; and aligning the implement mount and the implement using the first mark and a second mark in a forward direction relative to the carrier vehicle while the carrier vehicle moves towards the implement in the forward direction, wherein the second mark is visually recognizable from the carrier vehicle and is positioned on the implement at a location that aligns with the first mark when the implement is in position for coupling with the implement mount, and wherein the first mark is positioned on the implement mount at a location that is aimed at the second mark from a perspective of an operator driving the carrier vehicle when the carrier vehicle is aligned with the implement in the forward direction.

2. The method of claim 1, further comprising attaching the implement mount to the carrier vehicle.

3. The method of claim 1, wherein the first mark is a horizontal and vertically oriented cross.

4. The method of claim 3, wherein aligning the implement mount and the implement using the first mark and the second mark includes aiming the second mark at a center of the horizontal and vertically oriented cross from the perspective of the operator of the carrier vehicle while driving the carrier vehicle toward the implement.

5. The method of claim 1, further comprising attaching the implement to the implement mount.

6. The method of claim 1, wherein the first mark is a circle.

7. The method of claim 6, wherein aligning the implement mount and the implement using the first mark and the second mark includes aiming the second mark at the center of the circle from the perspective of the operator of the carrier vehicle while driving the carrier vehicle toward the implement.

8. The method of claim 1, wherein the implement is at least one selected from a group consisting of a feed shovel, a loading fork, a bale gripper, and a spike.

9. The method of claim 1, wherein the first mark is applied to a frame of the implement mount.

10. The method of claim 1, wherein the first mark is at least one selected from a group consisting of a point, an arrow, a circle, or an "X".

11. The method of claim 1, wherein the second mark is at least one selected from a group consisting of a point, an arrow, a circle, or an "X".

12. The method of claim 1, wherein the first mark includes at least one selected from a group consisting of a distinctive color, a distinctive surface structure, and a light-reflective surface.

13. The method of claim 1, wherein the second mark includes at least one selected from a group consisting of a distinctive color, a distinctive surface structure, and a light-reflective surface.

14. The method of claim 1, wherein aligning the implement mount and the implement using the first mark and the second mark includes steering the carrier vehicle to align the first mark with the second mark in the forward direction relative to the carrier vehicle from the perspective of the operator of the carrier vehicle while the carrier vehicle moves towards the implement in the forward direction.

15. The method of claim 14, wherein driving the carrier vehicle towards the implement includes driving a carrier vehicle including two front loader arms towards the implement, wherein the first mark is positioned between the two front loader arms and is visually recognizable from the carrier vehicle between the two front loader arms, and wherein the second mark is visually recognizable from the carrier vehicle between the two front loader arms when the first mark is aligned with the second mark in the forward direction relative to the carrier vehicle.

16. The method of claim 1, further comprising continuing to drive the carrier vehicle in the forward direction toward the implement with the first mark aligned with the second mark from the perspective of the operator of the carrier vehicle until the implement engages with the implement mount.

17. The method of claim 1, wherein the first mark is positioned on the implement mount at the location that is aimed at the second mark from the perspective of an operator cab of the carrier vehicle.

* * * * *